US010480181B1

(12) United States Patent
Norris

(10) Patent No.: US 10,480,181 B1
(45) Date of Patent: Nov. 19, 2019

(54) INSULATION SYSTEM FOR RESIDENTIAL CONSTRUCTION

(71) Applicant: PRECISION CONVERTERS, INC, Spartanburg, SC (US)

(72) Inventor: Ronald T. J. Norris, Moore, SC (US)

(73) Assignee: Precision Converters, Inc., Spartanburg, SC (US)

( * ) Notice: Subject to any disclaimer, the term of this patent is extended or adjusted under 35 U.S.C. 154(b) by 0 days.

(21) Appl. No.: 16/117,881

(22) Filed: Aug. 30, 2018

Related U.S. Application Data

(60) Provisional application No. 62/553,439, filed on Sep. 1, 2017.

(51) Int. Cl.
*E04B 1/76* (2006.01)
*E04F 21/00* (2006.01)

(52) U.S. Cl.
CPC ..... *E04B 1/7604* (2013.01); *E04F 21/00* (2013.01)

(58) Field of Classification Search
CPC ..... E04B 1/7604
See application file for complete search history.

(56) References Cited

U.S. PATENT DOCUMENTS 4,712,347 A 12/1987 Sperber
5,287,674 A 2/1994 Sperber
5,365,716 A * 11/1994 Munson ..... E04B 1/7604 52/404.1
5,819,496 A 10/1998 Sperber
6,584,749 B2 7/2003 Sperber
8,215,339 B2 * 7/2012 O'Leary ..... E04B 1/7604 137/360

* cited by examiner

*Primary Examiner* — Andrew J Triggs
(74) *Attorney, Agent, or Firm* — Dority & Manning P.A.

(57) ABSTRACT

Apparatus and method for installing loose-fill or dense pack fiberglass or cellulose insulation that is blown dry into the wall cavity of a building structure includes a drapeable sheet of fabric having a first region impermeable to passage of air and a second region contiguous with the first region, the second region being permeable to passage of air. The drapeable sheet of fabric is attached to the wall studs defining a plurality of cavities in the walls of a building structure. Once enough of the loose or dense packed fibers of fiberglass or cellulose to provide the desired degree of insulation has been blown into each of the cavities, then the second region of the sheet is covered at each cavity with a non-permeable strip so as to render the second region non-permeable to passage of air.

11 Claims, 4 Drawing Sheets

INSULATION SYSTEM FOR RESIDENTIAL CONSTRUCTION

FIELD

The present subject matter relates generally to an apparatus and method for installing loose or dense pack fiber insulation that is blown into cavities in building structures before the finished interior walls of the structure are erected.

BACKGROUND

Various types of apparatus and methods for installing loose or dense pack fiber insulation that is blown into cavities in building structures before the finished interior walls of the structure are erected are known. For instance, some of these apparatus and methods are described in the U.S. Pat. Nos. 4,712,347; 5,287,674; 5,819,496; and 6,584,749, which are hereby incorporated herein by this reference for all purposes. The system developed by Ark-Seal International in the 1980s blows fiberglass blowing wool into the cavities between wall studs after covering the entire front of the cavities with air permeable fabric that has been stapled to the front edges of the wall studs. While this system is effective in putting the loose fiber insulation in place between the wall studs, the air permeable fabric then must be covered with a non-permeable sheeting. The application of this non-permeable sheeting involves additional cost in materials as well as the time and labor needed for its application.

By way of background, both FIG. 1 and FIG. 2 are useful to get an idea of conventional installation of loose-fill fiberglass or cellulose insulation. FIG. 1 is a schematic representation of one way of introducing this loose-fill insulation into the wall cavity of residential construction. However, more desirably, as shown in FIG. 2, this installation would occur from inside the structure. However, FIG. 2 is a representation of a conventional way of applying foamed insulation rather than loose fill or dense pack insulation that is composed of individual fiberglass fibers or cellulose fibers.

SUMMARY

The present disclosure provides apparatus and method for installing loose-fill or dense pack fiberglass or cellulose insulation that is blown dry into the wall cavity of a building structure and overcomes various deficiencies in the conventional apparatus and installation method. The apparatus comprises a drapeable sheet of fabric having a first region that is substantially air impermeable and a second region contiguous with the first region that has an air permeability substantially greater than that of the first region. The drapeable sheet is dimensioned to comply with the wall height of the wall that is to be insulated. For example, the sheet may be dimensioned so as to extend vertically from a bottom beam of a wall to a top beam of the wall and horizontally across at least one wall cavity. The at least one wall cavity is defined by two vertical studs, the top beam, the bottom, and a back wall. The air permeable second region comprises a horizontal strip extending continuously across the at least one wall cavity.

Preferably, the drapeable sheet is dimensioned so as to extend horizontally across a plurality of wall cavities. For instance, the sheet may be a rectangular sheet having a length that extends across multiple wall cavities. Alternatively, the sheet may be dispensed as a roll having a width equal to the distance from the bottom beam of the wall to the top beam, so that the roll is dispensed horizontally across the plurality of wall cavities. In a preferred embodiment, the second region comprising the air permeable horizontal strip has uninterrupted permeability across the plurality of cavities. For instance, there is no air impermeable material disposed along any part of the horizontal strip of air permeable material.

The apparatus may further comprise a separate, non-permeable strip configured to cover the second region of the sheet. The non-permeable strip is adhered to the drapeable sheet after the insulation material is blown into the at least one cavity to seal the air permeable region of the sheet and render it substantially air impermeable. In a preferred embodiment, the non-permeable strip is a strip of tape dimensioned to cover the width of the air permeable horizontal strip and to extend continuously along the horizontal strip across the plurality of cavities. In another preferred embodiment, the non-permeable strip has adhesive edge portions and a non-adhesive center portion.

The apparatus may further comprise a third region that is substantially air impermeable. In one embodiment, the second, air permeable region is disposed between the first region and the third region. For example, the first and third regions may each have a width at least twice as great as the second region and be separated by the second region. Preferably, the width of the horizontal strip defining the second region is from about 8 inches to about 16 inches extending in the vertical direction and the width of the first region is greater than 24 inches.

The disclosure also provides a method for installing loose-fill or dense pack fiberglass or cellulose insulation that is blown dry into the wall cavity of a building structure. The method comprises attaching the drapeable sheet described above to a wall frame comprising the top beam, the bottom beam, and the wall studs; blowing the insulation into the at least one wall cavity; and then covering the second region of the sheet with the separate, non-permeable strip so as to render the second, air-permeable region substantially air impermeable.

BRIEF DESCRIPTION OF THE DRAWINGS

The accompanying drawings, which are incorporated in and constitute a part of this specification, illustrate embodiments of the invention and, together with the description, serve to explain the principles of the invention.

A full and enabling disclosure of the present invention, including the best mode thereof, directed to one of ordinary skill in the art, is set forth in the specification, which makes reference to the appended figures, in which.

DESCRIPTION OF EXEMPLARY EMBODIMENTS

Figure 1:
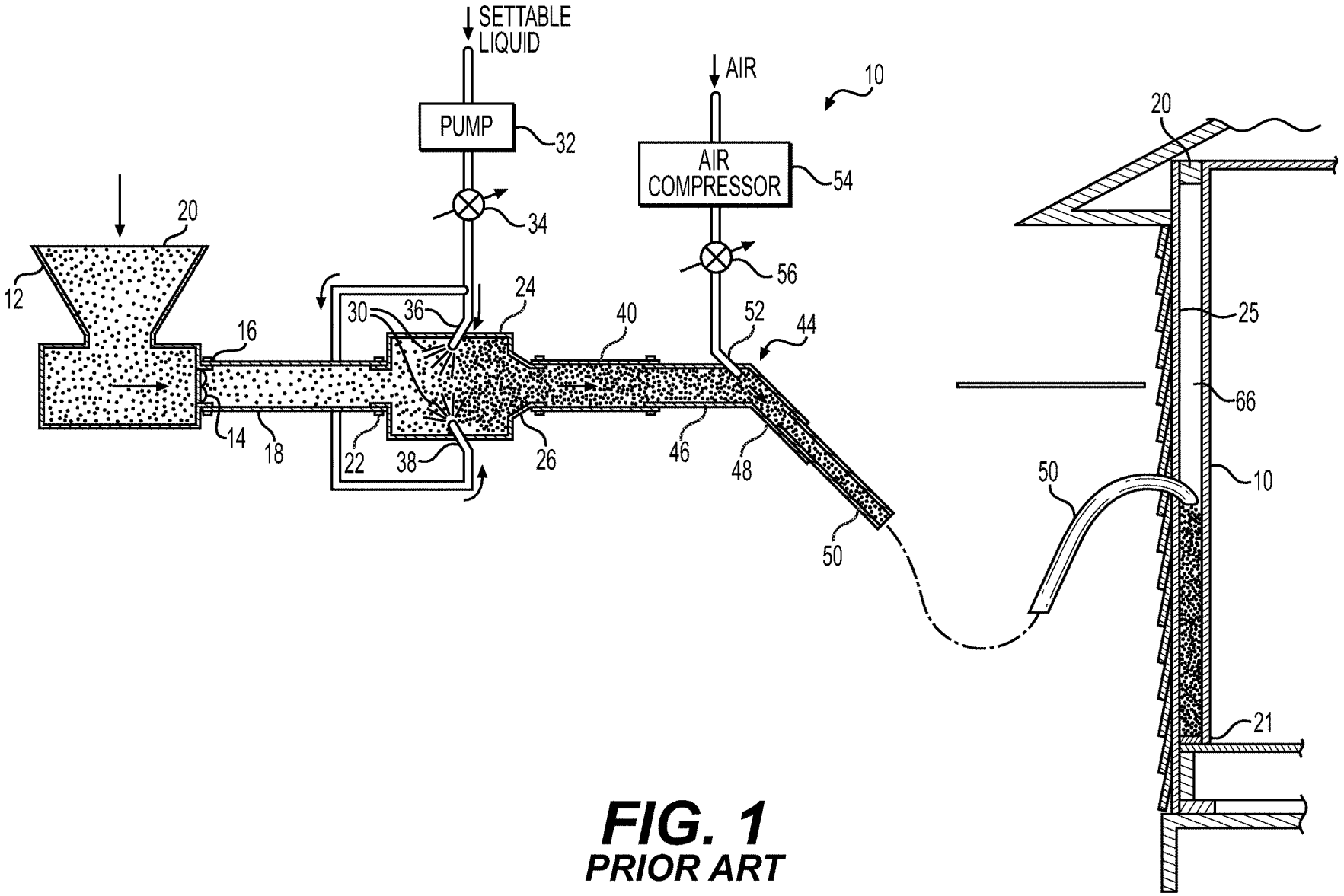
FIG. 1 PRIOR ART
FIG. 1 illustrates one type of conventional apparatus and method for installing insulation that is blown into cavities in building structures before the finished interior walls of the structure are erected.

Reference will now be made in detail to present embodiments of the invention, one or more examples of which are illustrated in the accompanying drawings, which were hand-drawn and annotated with word descriptions and dimensions that are only intended as exemplary embodiments. The detailed description uses numerical and letter designations to refer to features in the drawings. Like or similar designations in the drawings and description have been used to refer to like or similar parts of the invention, but due to the hand drawn nature of the drawings, these references may vary from figure to figure. As used herein, the terms "first," "second," and "third" may be used interchangeably to distinguish one component from another and are not intended to signify location or importance of the individual components.

Figure 3:
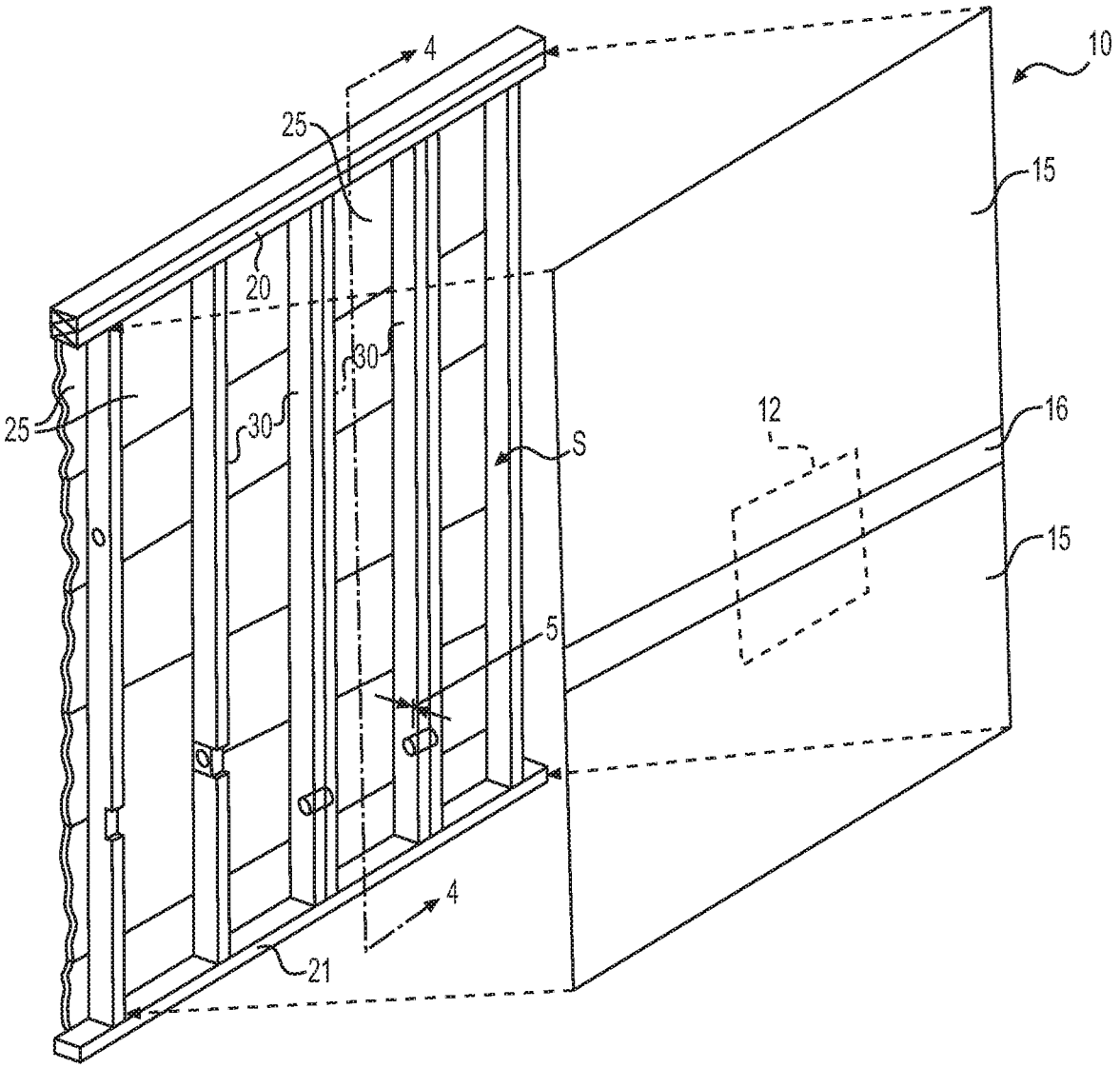
FIG. 3 provides a schematic representation of various components of an exemplary embodiment of the apparatus of the present invention as well as a schematic representation of some of the steps of the method of the present invention.

The key component of this invention is the fabric 10 shown in FIG. 3. The fabric 10 is used in the process of installing loose-fill or dense pack fiberglass or cellulose insulation that is blown dry into the wall cavities between the vertical wall studs of building structures, typical of residential construction, before the finished interior walls of the structure are erected. In one embodiment, the fabric 10 can be provided in individual sheet sections measuring approximately eight square feet (8 $ft.^2$). In a preferred embodiment, the sheet sections extend vertically from the bottom beam of the wall to the top beam of the wall and horizontally across multiple wall cavities. The sheet may extend horizontally across as many wall cavities as is desired.

Alternatively, the fabric 10 can be provided on a large roll that is a continuous sheet of fabric 10. In one embodiment, the sheet is about 8.5 feet wide for use in typical residential wall construction. The width of the sheet desirably corresponds roughly to the height of the wall that is to be covered with the sheet. Indeed, the dimensions of the fabric 10 can be tailored depending upon the dimensions of the structure (typically a wall) to which the fabric 10 is to be attached in the course of implementing the system for insulating the building structures.

The fabric 10 includes distinct sections that run continuously along the length of the sheet. In the embodiment shown in FIG. 3, each of the top section and the bottom section is composed of material (designated 15 in FIG. 3) that is substantially air impermeable, which means that less than 0.90 perms can pass through this material 15 in the environment specified in ASTM E96. However, the air vent strip 16 is formed of a substrate that is readily permeable to the passage of air, in contrast to the top and bottom sections 15. For instance, the air permeability of the air vent strip is substantially greater than that of the top and bottom sections. This air vent strip 16 desirably has a width of on the order of 1 foot, but 10 inches also is adequate for an 8.5 foot height from the top edge to the bottom edge of the fabric 10 shown in FIG. 3. Preferably, the width of the air vent strip is from about 8 inches to about 14 inches, such as from about 10 to about 12 inches. It should be wide enough to allow sufficient venting of air during the blowing of the installation but narrow enough that an adhesive strip of non-permeable material can be easily dispensed along the air vent strip. Moreover, the specific location of this air vent strip 16 need not be centrally located as shown in FIG. 3. The width of the air vent strip 16 can be varied so that more than one air vent strip 16 of smaller width dimension can be provided so long as enough area of permeable material is available for exhausting the volume of air being used to blow the fibers of fiberglass or cellulose into the wall cavity during this step of the installation method. Alternatively, the strip may be positioned at the top or bottom of the sheet proximate the top beam or the bottom beam. This would allow the sheet to have only two sections of material instead of three or more.

In one exemplary embodiment of the fabric 10, the air vent strip 16 is provided by a first panel of material that is a strip of material much longer than its width. This strip is attached along at least one of its elongated side edges to a corresponding elongated side edge of at least a second panel of material. In the exemplary embodiment depicted in FIG. 3, the first panel of air permeable material that forms the air vent strip 16 of the fabric 10 can be provided by a strip of 1.33 ounces per square yard of non-woven polypropylene that is 14 inches wide between the elongated side edges thereof and is composed of continuous filament polypropylene fibers. Each of the two non-permeable panels 15 forming the exemplary embodiment of the fabric 10 depicted in FIG. 3 can be provided by a sheet of one ounce per square yard of polypropylene that is 54 inches wide between the elongated side edges thereof and is composed of finely chopped polypropylene fibers that have been joined together with a patterned calendar roll and thereafter coated on one side by a 20 $g/m^2$ film composed of polyolefin and polyethylene. A two-inch-wide section along each opposite side edge of the air permeable first panel 16 is attached to a two inch wide section along one side edge of each of the respective non-permeable panels 15. These attachment seams can be made in any of a number of ways, including using a hot melt glue system, or sonic bonding, or stitching, or any combination of the foregoing.

Figure 2:
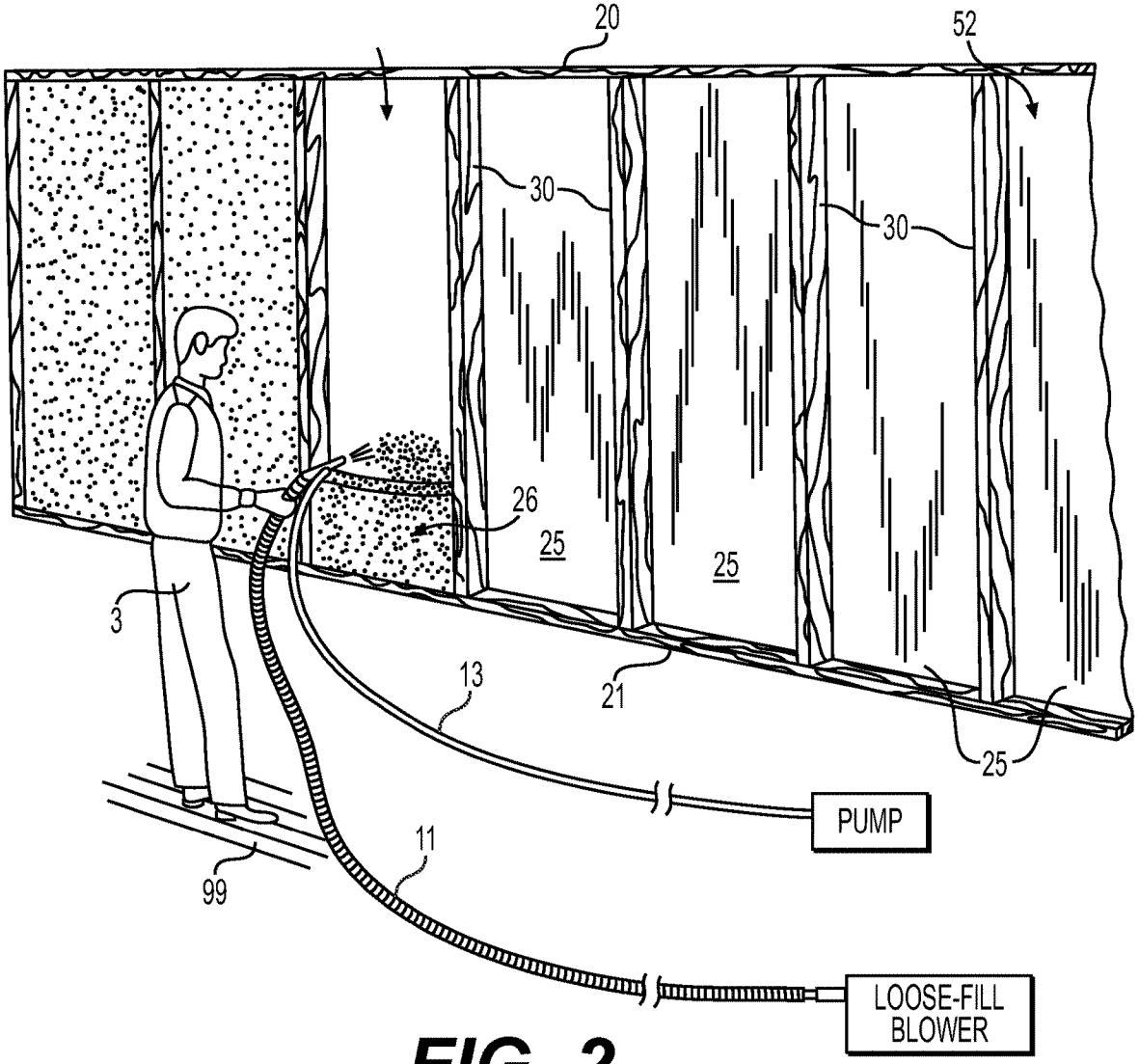
FIG. 2 PRIOR ART
FIG. 2 illustrates another type of conventional apparatus and methods for installing insulation that is blown into cavities in building structures before the finished interior walls of the structure are erected.
Figure 4:
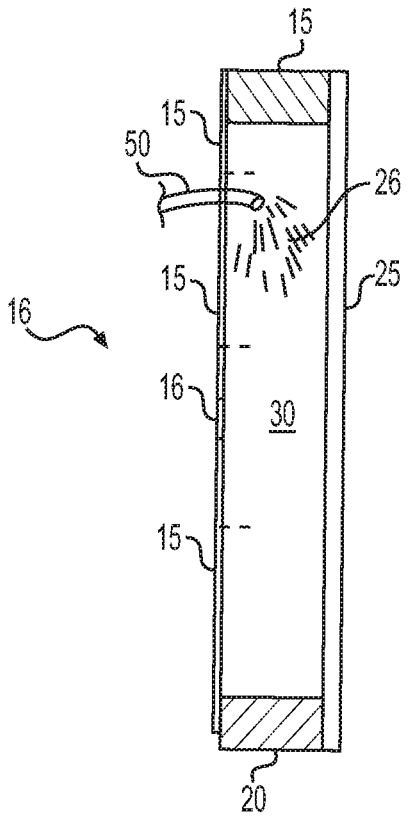
FIG. 4 is a schematic representation of a cross-sectional view taken generally along the lines of sight of the arrows designated in FIG. 3 by the numerals 4--4 as well as a schematic representation of some of the steps of the method of the present invention.

According to additional aspects of the invention, as shown in FIG. 3, a sheet of the fabric 10 will be tacked against the vertical studs 30, the top beam 20 and the bottom beam 21 that form the framing of the wall of the structure to create hollow cavities between the studs 30, the top beam 20, the bottom beam 21, the back wall 25 and the sheet of fabric 10. In FIG. 4, which schematically illustrates the view taken along the lines of sight 4-4 in FIG. 3, one can see how the fabric 10 is tacked to the stud 30, the top beam 20 and the bottom beam 21. Then a nozzle 50 will be inserted through a small slit made by the installer 3 (FIG. 2) in the fabric 10 at one or more locations and into each cavity that is formed between the studs 30, the top beam 20, the bottom beam 21, the back wall 25 and the sheet 10. The loose fill or dense pack fiber insulation 26 then is blown under pressure from this nozzle 50 by the installer 3 into each individual cavity. The air from this blowing operation escapes through the section of the permeable air vent strip 16 of the fabric 10 that covers over a narrow portion the front of the individual cavity.

Figure 5:
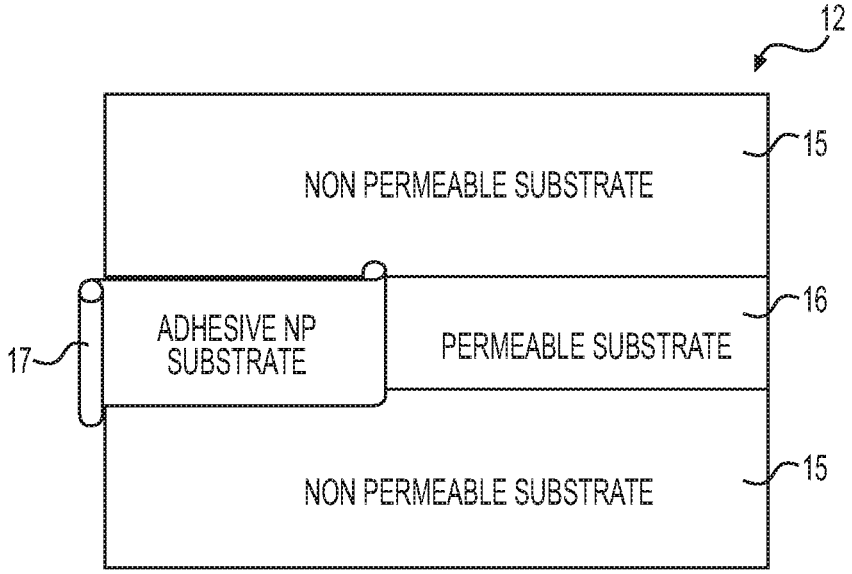
FIG. 5 provides a schematic representation of an enlarged section taken from the fabric sheet 10 outlined by the dashed line in FIG. 3 as well as a schematic representation of some of the steps of the method of the present invention.

Once all of the cavities in the building structure have been filled by the installer 3, the cavities may be sealed by covering the permeable air vent strip 16 with a non-permeable substrate 17 that is substantially air impermeable, which means that less than 0.90 perms can pass through this substrate 17 in the environment specified in ASTM E96. FIG. 5 schematically shows an enlarged section of the sheet of fabric 10 depicted in FIG. 3, and this enlarged section includes the permeable air vent strip 16. Ideally, as schematically shown in FIG. 5, this sealing operation can be accomplished by the installer applying a wide strip of non-permeable adhesive tape 17 along the entire length of the air vent strip 16. Once this strip of non-permeable adhesive tape 17 is attached to and covers the air vent strip 16 formed in the fabric 10, then the entire cavity of the building structure will have been sealed according to current building codes and be ready for erection of the finished interior walls of the structure.

Examples of the substrate 17 can include a role of tape that is 12 inches wide and formed of either non-woven polypropylene or a polypropylene film. One side of the substrate 17 is provided with an adhesive, which can cover the entire full 12 inch width of the substrate 17 or alternatively can be limited to just 2 inches on each of the opposite side edges and leaving the central 8 inch wide portion of the substrate 17 without any adhesive covering.

This written description uses examples to disclose the invention, including the best mode, and also to enable any person skilled in the art to practice the invention, including making and using any devices or systems and performing any incorporated methods. The patentable scope of the invention is defined by the claims and may include other examples that occur to those skilled in the art. Such other examples are intended to be within the scope of the claims if they include structural elements that do not differ from the literal language of the claims or if they include equivalent structural elements with insubstantial differences from the literal language of the claims.

What is claimed is:

1. An apparatus for installing loose-fill or dense pack fiberglass or cellulose insulation that is blown dry into a wall cavity of a wall of a building structure, wherein the wall includes a back wall, a top beam disposed vertically above a bottom beam, a plurality of vertical studs extending between the top and bottom beams, and a plurality of wall cavities, a width of each wall cavity defined between a pair of adjacent ones of the plurality of vertical studs, the apparatus comprising:

a drapeable sheet of fabric having a width so dimensioned as to extend vertically from the bottom beam of the wall to the top beam of the wall and having a length so dimensioned as to extend horizontally across at least one wall cavity, the at least one wall cavity defined in part by the top beam, the bottom beam, and the back wall, wherein the drapeable sheet of fabric having a first region that is substantially impermeable to air and a second region contiguous with the first region, the second region having a permeability to air substantially greater than the impermeability of the first region, wherein the air permeability of the second region is uninterrupted across the drapeable sheet of fabric, and a horizontal strip configured for extending continuously across an entire width of the at least one wall cavity and configured for covering the second region of the drapeable sheet of fabric.

2. The apparatus of claim 1, wherein the sheet is dimensioned so as to extend horizontally across the plurality of wall cavities and wherein the horizontal strip is configured to extend continuously across the plurality of wall cavities.

3. The apparatus of claim 1, wherein the horizontal strip comprises a separate, non-permeable strip attached to the drapeable sheet of fabric and covering the second region of the drapeable sheet of fabric so as to render the second region substantially air impermeable.

4. The apparatus of claim 3, wherein the non-permeable strip comprises tape.

5. The apparatus of claim 3, wherein the non-permeable strip has a pair of edges spaced apart from each other and adhesive portions extending along each edge of the strip and a non-adhesive portion extending along a center of the strip disposed between the pair of edges.

6. The apparatus of claim 1, wherein the sheet further comprises a third region that is substantially air impermeable and that is not contiguous with the first region.

7. The apparatus of claim 6, wherein the second region is disposed between the first region and the third region.

8. The apparatus of claim 1, wherein the first region has a moisture vapor transmission rate of less than 0.9 perms.

9. The apparatus of claim 1, wherein the drapeable sheet of fabric is formed into a roll configured to be dispensed horizontally across the plurality of wall cavities.

10. The apparatus of claim 1, wherein the horizontal strip has a width of from about 8 inches to about 16 inches extending in the vertical direction.

11. The apparatus of claim 1, wherein the width of the first region is at least twice as great as the width of the second region.

* * * * *